US008201620B2

(12) United States Patent
Aung et al.

(10) Patent No.: US 8,201,620 B2
(45) Date of Patent: Jun. 19, 2012

(54) EVAPORATOR UNIT

(75) Inventors: Thuya Aung, Kariya (JP); Tomohiko Nakamura, Obu (JP); Hideaki Sato, Anjo (JP); Toshio Utsumi, Okazaki (JP); Kazutoshi Yamamoto, Kariya (JP)

(73) Assignee: Denso Corporation, Kariya (JP)

( * ) Notice: Subject to any disclaimer, the term of this patent is extended or adjusted under 35 U.S.C. 154(b) by 645 days.

(21) Appl. No.: 12/454,418

(22) Filed: May 18, 2009

(65) Prior Publication Data

US 2009/0283247 A1 Nov. 19, 2009

(30) Foreign Application Priority Data

May 19, 2008 (JP) ..... 2008-130890

(51) Int. Cl.

| | |
|---|---|
| ***F28F 9/02*** | (2006.01) |
| ***F25B 5/04*** | (2006.01) |
| ***F25B 39/02*** | (2006.01) |
| ***F25B 39/00*** | (2006.01) |

(52) U.S. Cl. ..... 165/173; 165/11.1; 165/174; 165/176; 165/178; 165/152; 165/153; 62/500; 62/170; 62/515; 62/524; 62/525

(58) Field of Classification Search ..... 165/202, 165/178, 176, 175, 174, 173, 152, 153, 11.1; 62/500, 170, 515, 524, 525
See application file for complete search history.

(56) References Cited

U.S. PATENT DOCUMENTS

| | | | | |
|---|---|---|---|---|
| 7,178,359 | B2 * | 2/2007 | Oshitani et al. | 62/500 |
| 7,254,961 | B2 * | 8/2007 | Oshitani et al. | 62/500 |
| 7,654,108 | B2 * | 2/2010 | Ishizaka et al. | 62/500 |
| 7,707,849 | B2 * | 5/2010 | Ishizaka et al. | 62/500 |
| 7,770,412 | B2 * | 8/2010 | Ishizaka et al. | 62/500 |
| 2005/0178150 | A1 | 8/2005 | Oshitani et al. | |
| 2005/0268644 | A1 | 12/2005 | Oshitani et al. | |
| 2007/0169510 | A1 | 7/2007 | Ishizaka et al. | |
| 2007/0169511 | A1 | 7/2007 | Ishizaka et al. | |
| 2007/0169512 | A1 | 7/2007 | Ishizaka et al. | |
| 2008/0264097 | A1 | 10/2008 | Ishizaka et al. | |

FOREIGN PATENT DOCUMENTS

| | | |
|---|---|---|
| JP | 06-137695 | 5/1994 |
| JP | 2000-043557 | 2/2000 |
| JP | 2003-287158 | 10/2003 |
| JP | 2004-123036 | 4/2004 |
| JP | 2005-308384 | 11/2005 |
| JP | 2007-057222 | 3/2007 |
| JP | 2007-192502 | 8/2007 |
| JP | 2007-192503 | 8/2007 |
| JP | 2007-192504 | 8/2007 |
| JP | 2007-192504 | 9/2007 |

OTHER PUBLICATIONS

Office Action dated May 18, 2010 in Japanese Application No. 2008-130890 with English translation thereof.

* cited by examiner

*Primary Examiner* — John Ford
(74) *Attorney, Agent, or Firm* — Harness, Dickey & Pierce, PLC

(57) ABSTRACT

An evaporator unit includes an evaporator configured to evaporate a refrigerant, and a capillary tube configured to decompress the refrigerant. The capillary tube has two longitudinal ends bonded to the evaporator. At least one position of a middle portion between the two longitudinal ends of the capillary tube is fixed to the evaporator by press-contacting the evaporator. Therefore, it can prevent a crack from being caused at the bonding portions of the two longitudinal ends of the capillary tube.

13 Claims, 6 Drawing Sheets

EVAPORATOR UNIT

CROSS REFERENCE TO RELATED APPLICATION

This application is based on Japanese Patent Applications No. 2008-130890 filed on May 19, 2008, the contents of which are incorporated herein by reference in its entirety.

FIELD OF THE INVENTION

The present invention relates to an evaporator unit that includes an evaporator and a capillary tube. The evaporator unit can be suitably used for a refrigerant cycle device, for example.

BACKGROUND OF THE INVENTION

An evaporator unit including an evaporator and a capillary tube is described in JP 2007-192504A or JP 2005-308384A, for example. Furthermore, an evaporator unit for a refrigerant cycle device having an ejector is described in JP 2007-192504A, JP 2005-308384A, JP 2007-57222A or JP 6-137695A, for example.

In the evaporator unit described in JP 2007-192504A or JP 2005-308384A, the capillary tube is brazed to the evaporator to be bonded and sealed at its two ends. However, according to detail studies regarding bonding portion of the capillary tube by the inventors of the present application, the capillary tube may vibrate in accordance with the refrigerant flowing in the capillary tube, and a crack may be caused in the bonding portions at the two ends of the capillary tube, thereby causing a refrigerant leakage.

SUMMARY OF THE INVENTION

In view of the foregoing problems, it is an object of the present invention to provide an evaporator unit including a capillary tube and an evaporator, which can prevent a crack from being caused in bonding portions at two longitudinal ends of the capillary tube.

According to an aspect of the present invention, an evaporator unit includes an evaporator configured to evaporate a refrigerant, and a capillary tube configured to decompress the refrigerant. The capillary tube has two ends in a longitudinal direction of the capillary tube, and a middle portion between the two ends in the longitudinal direction. Furthermore, the two ends of the capillary tube are bonded to the evaporator, and at least one position of the middle portion of the capillary tube is fixed to the evaporator by press-contacting the evaporator. Thus, vibration of the capillary tube due to the refrigerant flow can be effectively reduced. Accordingly, the vibration of the capillary tube at the two longitudinal ends (i.e., at inlet and outlet) can be reduced, thereby preventing a crack of the bonding portions at the two longitudinal ends of the capillary tube.

Here, the two ends of the capillary tube can be directly bonded to the evaporator or can be indirectly bonded to the evaporator. The middle portion of the capillary tube may be press-fitted to the evaporator at plural positions in a zigzag shape.

The evaporator may have a plurality of tubes in which the refrigerant flows, and a tank extending in a tank longitudinal direction that is in parallel with an arrangement direction of the tubes to distribute the refrigerant into the tubes or to collect the refrigerant from the tubes. Furthermore, the tank may include a plate header having tube-insertion holes into which one-side ends of the tubes are inserted, and a tank header bonded to the plate header to form a tank space between the plate header and the tank header. In this case, the middle portion of the capillary tube is press-fitted to the tank header of the evaporator at least one position.

For example, the tank header may have at least one protrusion portion protruding to a position of the middle portion of the capillary tube, and the middle portion of the capillary tube may be press-fitted to the protrusion portion of the tank header. Furthermore, the tank header may have a valley portion extending along a longitudinal direction of the tank header and being recessed such that the capillary tube is inserted in the valley portion in a radial direction of the capillary tube. In this case, the protrusion portion protrudes from the valley portion to the middle portion of the capillary tube to press-contact the middle portion of the capillary tube.

The protrusion portion may protrude from the tank header by a dimension, to press-contact an outer surface of the capillary tube, and to bend the capillary tube. Alternatively, a plurality of the protrusion portions may be arranged by a predetermined distance in the longitudinal direction of the capillary tube. For example, the predetermined distance is equal to or smaller than 75 mm.

According to another aspect of the present invention, an evaporator unit includes an evaporator configured to evaporate a refrigerant, and a capillary tube configured to decompress the refrigerant. The evaporator includes a plurality of tubes in which the refrigerant flows, and a tank extending in a tank longitudinal direction that is in parallel with an arrangement direction of the tubes to distribute the refrigerant into the tubes or to collect the refrigerant from the tubes. Furthermore, the tank has a valley portion extending along the tank longitudinal direction and being recessed, and at least one protrusion portion protruding from the valley portion. In addition, the capillary tube is inserted in the valley portion in a radial direction of the capillary tube to extend in the tank longitudinal direction, two longitudinal ends of the capillary tube are bonded to the evaporator to be fixed thereto, and the capillary tube is press-fitted to the protrusion portion at a middle portion between the two longitudinal ends of the capillary tube. Accordingly, the vibration of the capillary tube at the two longitudinal ends (i.e., inlet and outlet) can be reduced, thereby preventing a crack of the bonding portions at the two longitudinal ends of the capillary tube.

For example, the tank may have a plurality of protrusion portions protruding from the valley portion to positions of the middle portion of the capillary tube on both sides of the valley portion. In this case, the protrusion portions are offset from each other in the tank longitudinal direction, and the middle portion of the capillary tube is partially press-fitted to the protrusion portions of the tank. Accordingly, vibrations due to the refrigerant flow can be effectively reduced.

BRIEF DESCRIPTION OF THE DRAWINGS

Additional objects and advantages of the present invention will be more readily apparent from the following detailed description of embodiments when taken together with the accompanying drawings. In the drawings.

DETAILED DESCRIPTION OF THE PREFERRED EMBODIMENTS

First Embodiment

A first embodiment of the present invention and modifications of the first embodiment will be described below with reference to FIGS. 1 to 5. In the present embodiment, an evaporator unit is typically used as an evaporator unit for an ejector refrigerant cycle device and an ejector refrigerant cycle device using the evaporator unit will be now described. The evaporator unit can be used for a refrigerant cycle device without having an ejector.

The evaporator unit is connected to other components of the refrigerant cycle device, including a condenser (refrigerant cooler), a compressor, and the like, via piping. The evaporator unit of the present embodiment is used for application to an indoor equipment (i.e., evaporator) for cooling air. However, the evaporator unit may be used as an outdoor equipment in other examples.

Figure 1:
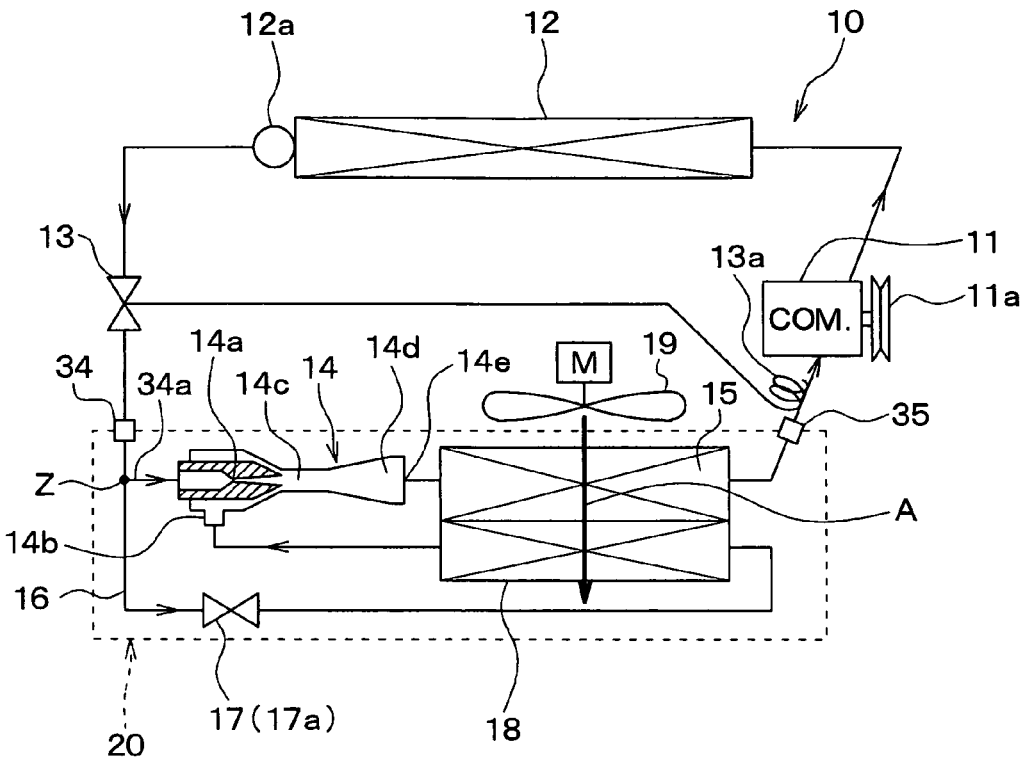
FIG. 1 is a schematic diagram showing a refrigerant cycle device with an ejector and a throttle (capillary tube), according to a first embodiment of the present invention.

In an ejector refrigerant cycle device 10 shown in FIG. 1, a compressor 11 for drawing and compressing refrigerant is driven by an engine for vehicle traveling (not shown) via an electromagnetic clutch 11*a*, a belt, or the like. The ejector refrigerant cycle device 10 is a refrigerant cycle device with an ejector.

As the compressor 11, may be used either a variable displacement compressor which can adjust a refrigerant discharge capability by a change in discharge capacity, or a fixed displacement compressor which can adjust a refrigerant discharge capability by changing an operating ratio of the compressor through engagement and disengagement of an electromagnetic clutch 11*a*. If an electric compressor is used as the compressor 11, the refrigerant discharge capability of the compressor 11 can be adjusted or regulated by adjustment of the number of revolutions of an electric motor.

A refrigerant radiator 12 is disposed on a refrigerant discharge side of the compressor 11. The radiator 12 exchanges heat between the high-pressure refrigerant discharged from the compressor 11 and outside air (i.e., air outside a compartment of a vehicle) blown by a cooling fan (not shown) thereby to cool the high-pressure refrigerant.

As the refrigerant for the ejector refrigerant cycle device 10 in the present embodiment, is used a refrigerant whose high pressure does not exceed a critical pressure, such as a flon-based refrigerant, or a HC-based refrigerant, so as to form a vapor-compression subcritical cycle. Thus, the radiator 12 serves as a condenser for cooling and condensing the refrigerant in this embodiment.

A liquid receiver 12*a* is provided at a refrigerant outlet side of the radiator 12. The liquid receiver 12*a* has an elongated tank-like shape, as is known generally, and constitutes a vapor-liquid separator for separating the refrigerant into vapor and liquid phases to store therein an excessive liquid refrigerant of the refrigerant cycle. At a refrigerant outlet of the liquid receiver 12*a*, the liquid refrigerant is derived from the lower part of the interior in the tank-like shape. In the present embodiment, the liquid receiver 12*a* is integrally formed with the radiator 12.

The radiator 12 may have a known structure which includes a first heat exchanger for condensation positioned on the upstream side of a refrigerant flow, the liquid receiver 12*a* for allowing the refrigerant introduced from the first heat exchanger for condensation and for separating the refrigerant into vapor and liquid phases, and a second heat exchanger for supercooling the saturated liquid refrigerant from the liquid receiver 12*a*.

A thermal expansion valve 13 is disposed on an outlet side of the liquid receiver 12*a*. The thermal expansion valve 13 is a decompression unit for decompressing the liquid refrigerant flowing from the liquid receiver 12*a*, and includes a temperature sensing part 13*a* disposed in a refrigerant suction passage of the compressor 11.

The thermal expansion valve 13 detects a degree of superheat of the refrigerant at the compressor suction side based on the temperature and pressure of the suction side refrigerant of the compressor 11, and adjusts an opening degree of the valve, such that the superheat degree of the refrigerant on the compressor suction side becomes a predetermined value which is preset, as is known generally. Therefore, the thermal expansion valve 13 adjusts a refrigerant flow amount such that the superheat degree of the refrigerant on the compressor suction side becomes the predetermined value.

An ejector 14 is disposed at a refrigerant outlet side of the thermal expansion valve 13. The ejector 14 is decompression means for decompressing the refrigerant as well as refrigerant circulating means (kinetic vacuum pump) for circulating the refrigerant by a suction effect (entrainment effect) of the refrigerant flow jetted at high speed.

The ejector 14 includes a nozzle portion 14*a* for further decompressing and expanding the refrigerant (i.e., the middle-pressure refrigerant from the expansion valve) by restricting a path area of the refrigerant having passed through the expansion valve 13 to a small level. A refrigerant suction port 14*b* is provided in the ejector 14 in the same space as a refrigerant jet port of the nozzle portion 14*a* so as to draw the vapor-phase refrigerant from a second evaporator 18 as described later.

A mixing portion 14*c* is provided on a downstream side of the refrigerant flow of the nozzle portion 14*a* and the refrigerant suction port 14*b*, for mixing a high-speed refrigerant flow jetted from the nozzle portion 14*a* and the refrigerant drawn from the refrigerant suction port 14*b*.

A diffuser 14*d* serving as a pressure-increasing portion is provided on a downstream side of the refrigerant flow of the mixing portion 14*c* in the ejector 14. The diffuser 14*d* is formed in such a manner that a path area of the refrigerant is generally increased toward downstream from the mixing portion 14*c*. The diffuser 14*d* serves to increase the refrigerant pressure by decelerating the refrigerant flow, that is, to convert the speed energy of the refrigerant into the pressure energy.

A first evaporator 15 is connected to an outlet side of the diffuser 14*d* of the ejector 14. A refrigerant outlet side of the first evaporator 15 is coupled to a refrigerant suction side of the compressor 11.

On the other hand, a refrigerant branch passage 16 is provided to be branched from a branch portion at an inlet side of the nozzle portion 14*a* of the ejector 14. That is, the refrigerant branch passage 16 is branched at the branch portion between the refrigerant outlet of the thermal expansion valve 13 and the refrigerant inlet of the nozzle portion 14*a* of the ejector 14. The downstream end side of the refrigerant branch passage 16 is connected to the refrigerant suction port 14*b* of the ejector 14. A point Z of FIG. 1 indicates the branch portion of the refrigerant branch passage 16.

In the refrigerant branch passage 16, a throttle 17 (e.g., capillary tube 17*a*) is disposed to decompress the refrigerant passing therethrough. On the refrigerant flow downstream side of the throttle 17 in the refrigerant branch passage 16, the second evaporator 18 is disposed. The throttle 17 serves as a decompression unit which decompresses the refrigerant while performing a function of adjusting a refrigerant flow amount flowing into the second evaporator 18. More specifically, the throttle 17 can be constructed with a fixed throttle, such as a capillary tube, or an orifice.

In the first embodiment, the two evaporators 15 and 18 are incorporated into an integrated structure with an arrangement as described later. The two evaporators 15 and 18 are accommodated in an air conditioning case not shown, and the air (air to be cooled) is blown by a common electric blower 19 through an air passage formed in the air conditioning case in the direction of an arrow "A", so that the blown air is cooled by the two evaporators 15 and 18.

The cooled air by the two evaporators 15 and 18 is fed to a common space to be cooled (not shown). This causes the two evaporators 15 and 18 to cool the common space to be cooled. Among these two evaporators 15 and 18, the first evaporator 15 connected to a main flow path on the downstream side of the ejector 14 is disposed on the upstream side (upwind side) of the air flow A, while the second evaporator 18 connected to the refrigerant suction port 14*b* of the ejector 14 is disposed on the downstream side (downwind side) of the air flow A.

When the ejector refrigerant cycle device 10 of the present embodiment is used as a refrigeration cycle for a vehicle air conditioner, the space within a passenger compartment of the vehicle is the space to be cooled. When the ejector refrigerant cycle device 10 of the present embodiment is used for a refrigeration cycle for a freezer car, the space within the freezer and refrigerator of the freezer car is the space to be cooled.

In the present embodiment, the ejector 14, the first and second evaporators 15 and 18, and the throttle 17 are incorporated into one integrated unit so as to form an evaporator unit 20.

Figure 2:
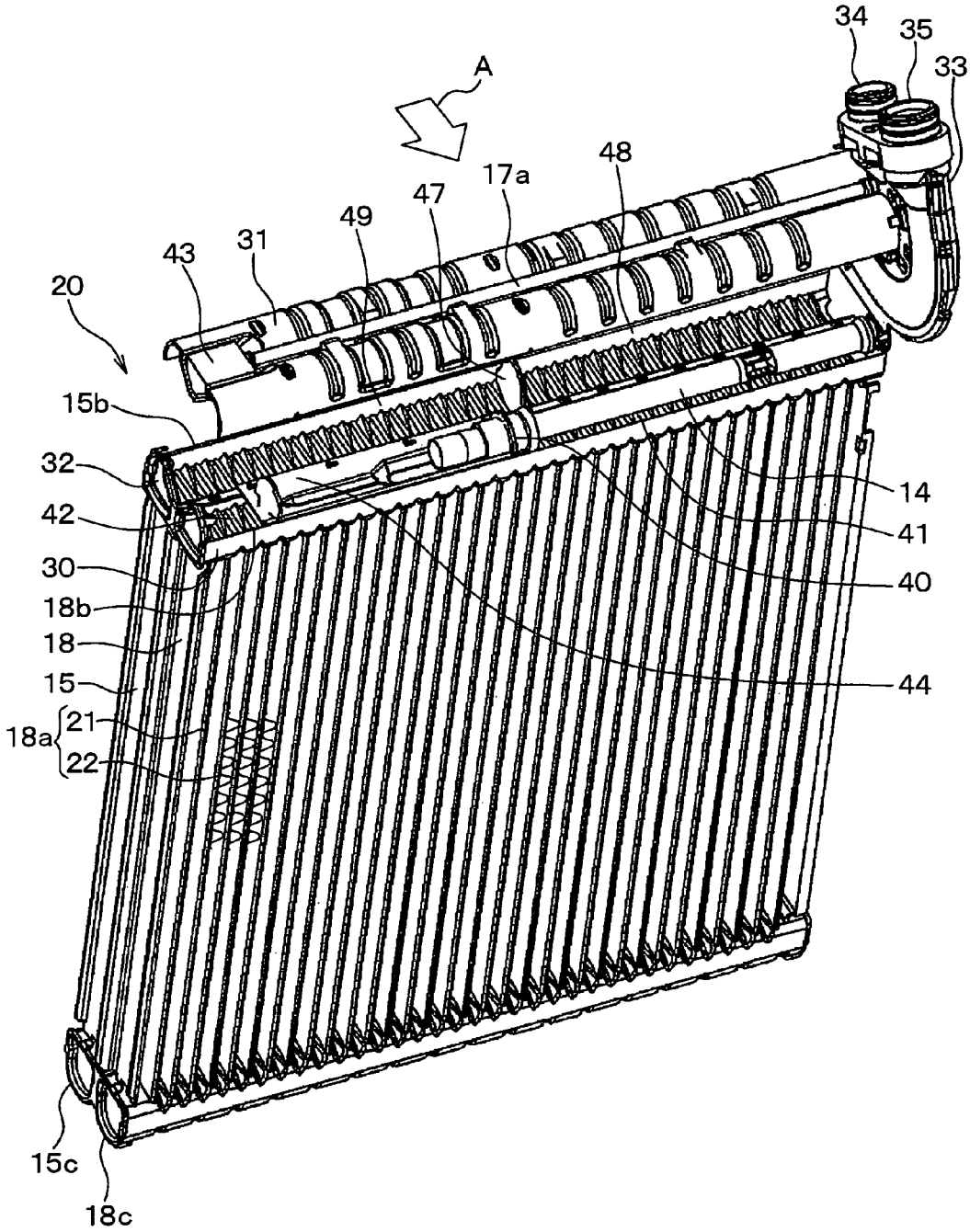
FIG. 2 is a disassembled perspective view showing a schematic structure of an evaporator unit for the refrigerant cycle device of the first embodiment.
Figure 3:
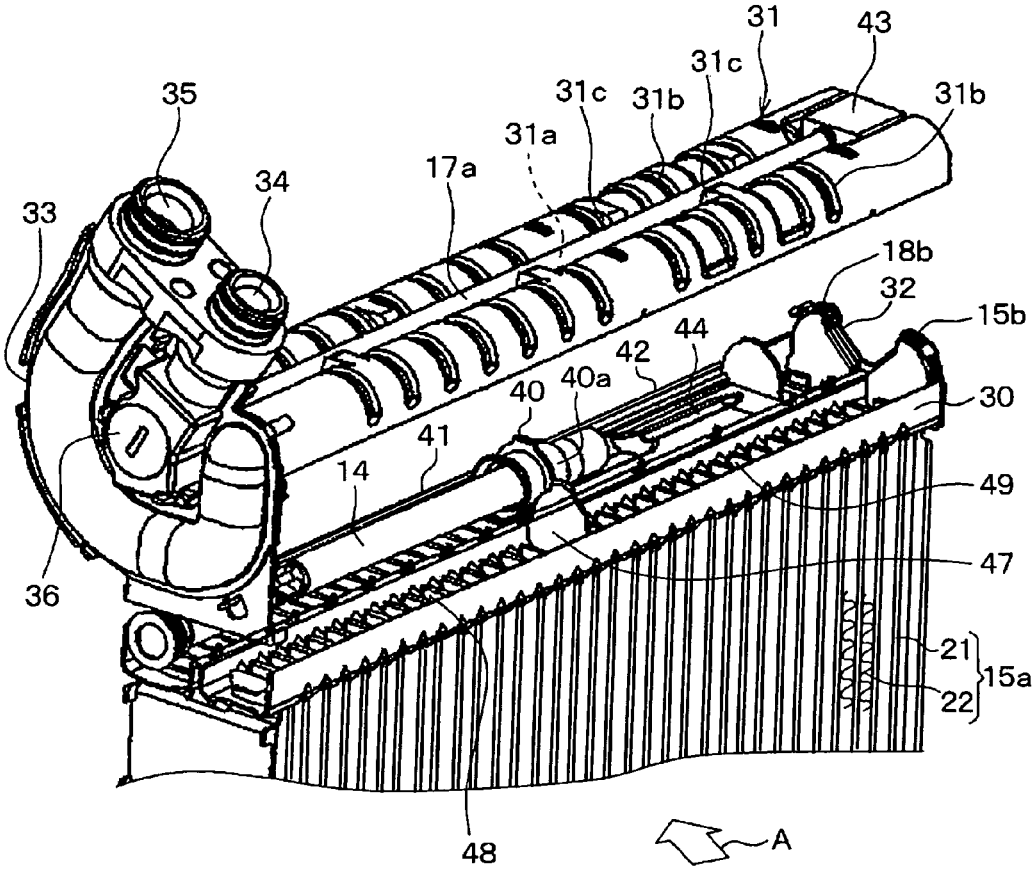
FIG. 3 is a disassembled perspective view showing a part of the evaporator unit according to the first embodiment.
Figure 4A:
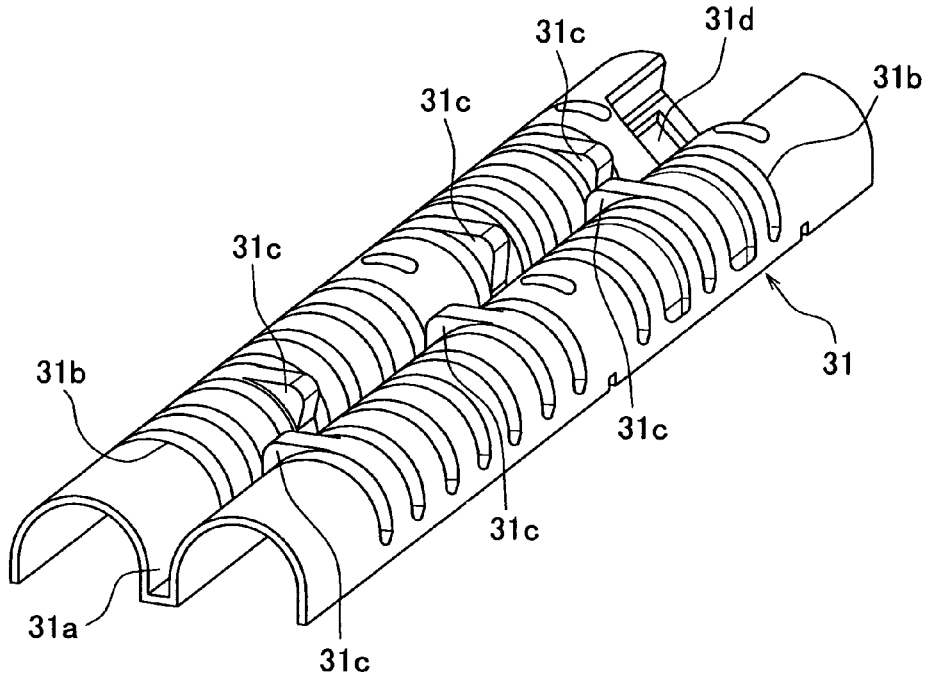
FIG. 4A is a perspective view showing a tank header for the evaporator unit before a capillary tube is attached.
Figure 4B:
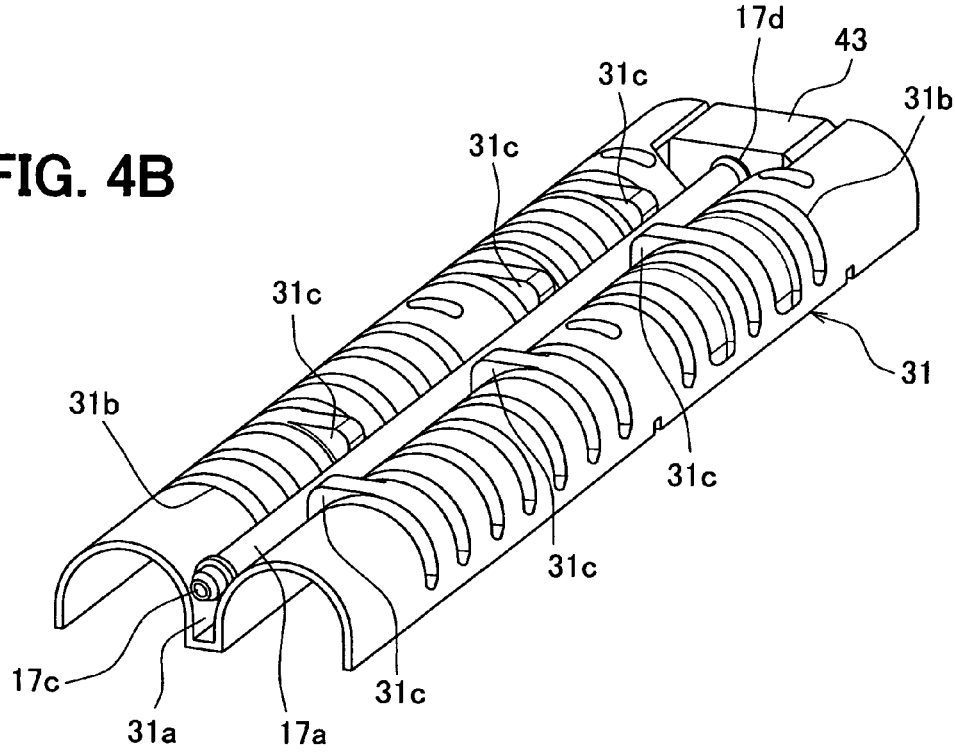
FIG. 4B is a perspective view showing the tank header after the capillary tube is attached, according to the first embodiment.

Now, specific examples of the evaporator unit 20 will be described below in detail with reference to FIGS. 2 to 5. FIGS. 2 and 3 are perspective views showing the evaporator unit 20 having the first and second evaporators 15 and 18 and a capillary tube 17*a* used as the throttle 17. FIG. 4A is a perspective view showing an upper tank header 31 of the first and second evaporators 15, 18 before the capillary tube 17*a* is attached, and FIG. 4B is a perspective view showing the upper tank header 31 of the first and second evaporators 15, 18 after the capillary tube 17*a* is attached.

First, an example of the integrated unit (evaporator unit 20) including the two evaporators 15 and 18 will be explained below with reference to FIG. 2. In the present embodiment of FIG. 2, the two evaporators 15 and 18 can be formed integrally into a completely single evaporator structure. Thus, the first evaporator 15 constitutes an upstream side area of the single evaporator structure in the direction of the air flow A, while the second evaporator 18 constitutes a downstream side area of the single evaporator structure in the direction of the air flow A.

In the example of the evaporator unit 20 of FIG. 2, a side of the tank portion where the capillary tube 17*a* is located is indicated as the top direction, and a side of the tank portion where the capillary tube 17*a* is not located is indicated as the bottom direction.

The first evaporator 15 and the second evaporator 18 have the same basic structure, and include heat exchange cores 15*a* and 18*a*, and tanks 15*b*, 15*c*, 18*b*, and 18*c* positioned on both upper and lower sides of the heat exchange cores 15*a* and 18*a*, respectively.

The heat exchanger cores 15*a* and 18*a* respectively include a plurality of tubes 21 extending in a tube longitudinal direction (e.g., top-bottom direction in FIG. 2). The tube 21 is a flat tube defining therein a refrigerant passage in which the refrigerant flows. One or more passages for allowing a heat-exchange medium, namely air to be cooled in the present embodiment, to pass therethrough are formed between the tubes 21. Between the adjacent tubes 21, fins 22 are disposed, so that the tubes 21 can be connected to the fins 22. Each of the heat exchange cores 15*a* and 18*a* is constructed of a laminated structure of the tubes 21 and the fins 22. The tubes 21 and fins 22 are alternately laminated in a lateral direction of the heat exchange cores 15*a* and 18*a*, as shown in FIG. 2. In other embodiments, any appropriate structure without using the fins 22 in the heat exchange cores 15*a* and 18*a* may be employed.

In FIGS. 2 and 3, only some of the fins 22 are shown, but in fact the fins 22 are disposed over the whole areas of the heat exchange cores 15*a* and 18*a*, and the laminated structure including the tubes 21 and the fins 22 is disposed over the whole areas of the heat exchange cores 15*a* and 18*a*. The blown air by the electric blower 19 is adapted to pass through voids (clearances) in the laminated structure of the tubes 21 and the fins 22.

The tube 21 constitutes the refrigerant passage through which refrigerant flows, and is made of a flat tube having a flat cross-sectional shape in the air flow direction A. The fin 22 is a corrugated fin made by bending a thin plate in a wave-like shape, and is connected to a flat outer surface of the tube 21 to increase a heat transfer area of the air side.

The tanks 15*b* and 15*c* are located, respectively, at top and bottom sides of the heat exchange core 15*a*, and the tanks 18*b* and 18*c* are located, respectively, at top and bottom sides of the heat exchange core 18*a* so as to form independent tank spaces independent from the tank spaces of the tanks 15*b* and 15*c*. In the first embodiment, the ejector 14 is located in the upper tank 18*b*, as an example. However, the ejector 14 may be provided at a position different from the upper tank 18*b* or may be provided outside of the evaporator unit 20.

The tanks 15*b*, 15*c*, 18*b*, 18*c* are connected to end portions of the tubes 21 in the longitudinal direction to distribute the refrigerant into the tubes 21 and to collect the refrigerant from the tubes 21.

The tanks 15*b*, 15*c* located on both the top and bottom sides of the first evaporator 15 have tube-fitting hole part (not shown), and both top and bottom end portions of the tubes 21 of the heat exchange core 15*a* are inserted into and are bonded to the tube-fitting hole part, such that the both top and bottom end portions of the tubes 21 communicate with the inner space of the tanks 15*b*, 15*c*.

Similarly, the tanks 18*b*, 18*c* located on both top and bottom sides of the second evaporator 18 have tube-fitting hole part (not shown), and both top and bottom end portions of the tubes 21 of the heat exchange core 18*a* are inserted into and are bonded to the tube-fitting hole part, such that the both top and bottom end portions of the tubes 21 communicate with the inner space of the tanks 18*b*, 18*c*.

The tubes 21 of the heat exchanger core 15*a* and the tubes 21 of the heat exchanger core 18*a* independently constitute the respective refrigerant passages. The tanks 15*b* and 15*c* on both upper and lower sides of the first evaporator 15, and the tanks 18*b* and 18*c* on both upper and lower sides of the second evaporator 18 independently constitute the respective refrigerant passage spaces.

Thus, the tanks 15*b*, 15*c*, 18*b*, and 18*c* disposed on both upper and lower sides serve to distribute the refrigerant to the respective tubes 21 of the heat exchange cores 15*a* and 18*a*, and to collect the refrigerant from the tubes 21 of the heat exchange cores 15*a* and 18*a*.

Because the two upper tanks 15*b* and 18*b* are arranged adjacent to each other, the two upper tanks 15*b* and 18*b* can be molded integrally to form an upper tank portion of the evaporator unit 20. The same can be made for the two lower tanks 15*c* and 18*c* so as to form a lower tank portion of the evaporator unit 20. The two upper tanks 15*b* and 18*b* may be molded independently as independent components, and that the same can be made for the two lower tanks 15*c* and 18*c*.

In the example of FIGS. 2 and 3, the upper tanks 15*b*, 18*b* can be divided into a plate header 30, a tank header 31 and a cap 32.

The plate header 30 has an approximately W-like cross section configuring integrally respective bottom-side half portions of the upper tanks 15*b*, 18*b*. The top ends of the tubes 21 are inserted into the plate header 30, and are bonded to the plate header 30. The tank header 31 has an approximately M-like cross section configuring integrally respective top-side half portions of the upper tanks 15*b*, 18*b*. Each of the plate header 30 and tank header 31 can be formed integrally by molding or pressing.

When the plate header 30 and the tank header 31 are combined in the top-bottom direction, the center portion of the approximately W-like cross section of the plate header 30 and the center portion of the approximately M-like cross 25 section of the tank header 31 are tightly bonded so as to form two cylindrical tank space portions. One side ends (left side ends in FIG. 2) of the two cylindrical space portions of the upper tanks 15*b*, 18*b* are closed by a cap 32 so as to form tank spaces of the upper tanks 15*b*, 18*b*.

As shown in FIGS. 3, 4A and 4B, a valley portion 31*a* recessed to the tank inner side is provided at the center portion of the approximately M-like cross section of the tank header 31, and the capillary tube 17*a* used as the throttle 17 is located at the valley portion 31*a*. The valley portion 31*a* is provided approximately along the entire length of the tank header 31, and the capillary tube 17*a* is provided at the valley portion 31*a* to extend approximately along the entire length of the tank header 31. The two ends of the capillary tube 17*a* are connected to communicate with other components of the refrigerant cycle device 10.

A plurality of circular-arc shaped ribs 31*b* are provided in the tank header 31 at two sides of the valley portion 31*a*, so as to reinforce the tank header 31. Because the ribs 31*b* are formed in the tank header 31, the pressure resistance of the tank header 31 can be increased.

The components of the evaporator unit 20, such as the tubes 21, the fins 22, the tanks 15*b*, 15*c*, 18*b*, 18*c* are made of metal such as aluminum material having a sufficient brazing property, and are brazed integrally so that the entire structure of the first evaporator 15 and the second evaporator 18 are integrally assembled.

For example, the plate header 30 and the tank header 31 are formed from press-molded aluminum plates. The ribs 31*b* is formed integrally with the tank header 31 while the press-molding.

In the present embodiment, as shown in FIGS. 2 and 3, a joint portion 33 and capillary tube 17*a* used as the throttle 17 or the like are integrally assembled with the first and second evaporators 15, 18.

The nozzle portion 14*a* of the ejector 14 has therein a fine passage with a high accuracy. When the ejector 14 is brazed, the nozzle portion 14*a* may be thermally deformed in the brazing at a high brazing temperature (e.g., 600° C. of aluminum brazing). Thus, if the brazing of the ejector 14 is performed after the ejector 14 is attached to the first and second evaporators 15, 18, the passage shape and the passage dimension of the nozzle portion 14*a* may be deformed.

Thus, in the present embodiment, the ejector 14 is assumed to the first and second evaporators 15, 18, after the first and second evaporators 15, 18, the joint portion 33 and the capillary tube 17*a* and the like are integrally brazed.

For example, the ejector 14, the capillary tube 17*a* and the joint portion 33 may be formed from an aluminum material, similarly to the first and second evaporators 15, 18.

As shown in FIGS. 3, 4A and 4B, the capillary tube 17*a* is arranged in the valley portion 31*a* of the tank header 31 such that the longitudinal direction of the capillary tube 17*a* is parallel with the tank longitudinal direction of the tanks 15*b*, 18*b*. Thus, the capillary tube 17*a* can be inserted into the valley portion 31*a* in a radial direction of the tank header 31, so as to be fixed to the tank header 31.

Protrusion portions 31*c* are formed at plural positions of the tank header 31 in the tank longitudinal direction. The protrusion portions 31*c* protrude from the valley portion 31*a* to the capillary tube 17*a* at plural positions of the capillary tube 17*a* between the two longitudinal ends of the capillary tube 17*a*. In the present embodiment, the protrusion portions 31*c* are formed integrally with the tank header 31 by pressing. For example, a part of the wall portion of the tank header 31, defining the tank passage, is pressed to outside, so that the protrusion portions 31*c* are formed.

The protrusion portions 31*c* are formed in the tank header 31 at two sides of the valley portion 31*a* and are offset from each other in the longitudinal direction of the capillary tube 17*a*. For example, the protrusion portions 31*c* formed at the two sides of the valley portion 31*a* may be offset from each other at equal distance in the extending direction (tank longitudinal direction) of the tank header 31.

As an example of the present embodiment, the protrusion portions 31*c* can be spaced from each other in the longitudinal direction of the tank header 31 by a distance equal to or smaller than 75 mm. Furthermore, a distance from the longitudinal end of the capillary tube 17*a* to the outmost protrusion portion 31*c* that is the closest one from the longitudinal end of the capillary tube 17*a* is also set equal to or smaller than 75 mm.

When viewing the protrusion portions 31*c* of the tank header 31 from the tank longitudinal direction (i.e., the longitudinal direction of the capillary tube 17*a*), a clearance between the protrusion portions 31*c* is slightly smaller than the outer diameter of the capillary tube 17*a*.

Thus, the capillary tube 17*a* can be press-fitted between the protrusion portions 31*c* at the two sides of the valley portion 31*a*, and is brazed to the protrusion portions 31*c* in the press-fitted state.

While the evaporator unit 20 is manufactured, a brazing step is performed after a temporarily assemble step. In the temporarily assemble step, the capillary tube 17*a* is fitted into the valley portion 31*a* of the tank header 31 from an upper side of the tank header 31. The capillary tube 17*a* is slightly bent to be pressed to the protrusion portions 31*c* that are alternately provided at the two sides of the valley portion 31*a* in the longitudinal direction of the capillary tube 17*a*.

In the temporarily assemble step, the capillary tube 17*a* is deformed to be slightly corrugated, and is fitted between the protrusion portions 31*c*. In the brazing step, the capillary tube 17*a* is bonded to the protrusion portions 31*c* of the tank header 31. The capillary tube 17*a* is bonded to the tank header 31*a* at its two ends, and is also bonded to the tank header 31*a* at contact portions contacting the protrusion portions 31*c* between the two ends of the capillary tube 17*a*. As shown in FIG. 4B, the capillary tube 17*a* partially contacts the protrusion portions 31*c* at the contact portions.

The protrusion portion 31*c* has a rounded corner portion when being viewed from a direction parallel with tank longitudinal direction (i.e., extending direction of the capillary tube 17*a*). The rounded corner portion is provided at each of the protrusion portions 31*c*, so as to prevent the capillary tube 17*a* from being damaged when the capillary tube 17*a* is assembled to the header tank 31. Furthermore, because the rounded corner portion is provided at each of the protrusion portions 31*c*, the capillary tube 17*a* can be smoothly assembled to the tank header 31.

The joint portion 33 is a member brazed and fixed to a side surface portion positioned at one side (e.g., left side in FIG. 3) of the longitudinal direction of the upper tanks 15*b*, 18*b* of the first and second evaporators 15, 18. The joint portion 33 is configured to have a single refrigerant inlet 34, a single refrigerant outlet 35, an ejector-insertion hole portion through which the ejector 14 is inserted into the upper tank 18*b*, in the evaporator unit 20. The joint portion 33 is formed from an aluminum material.

Figure 5:
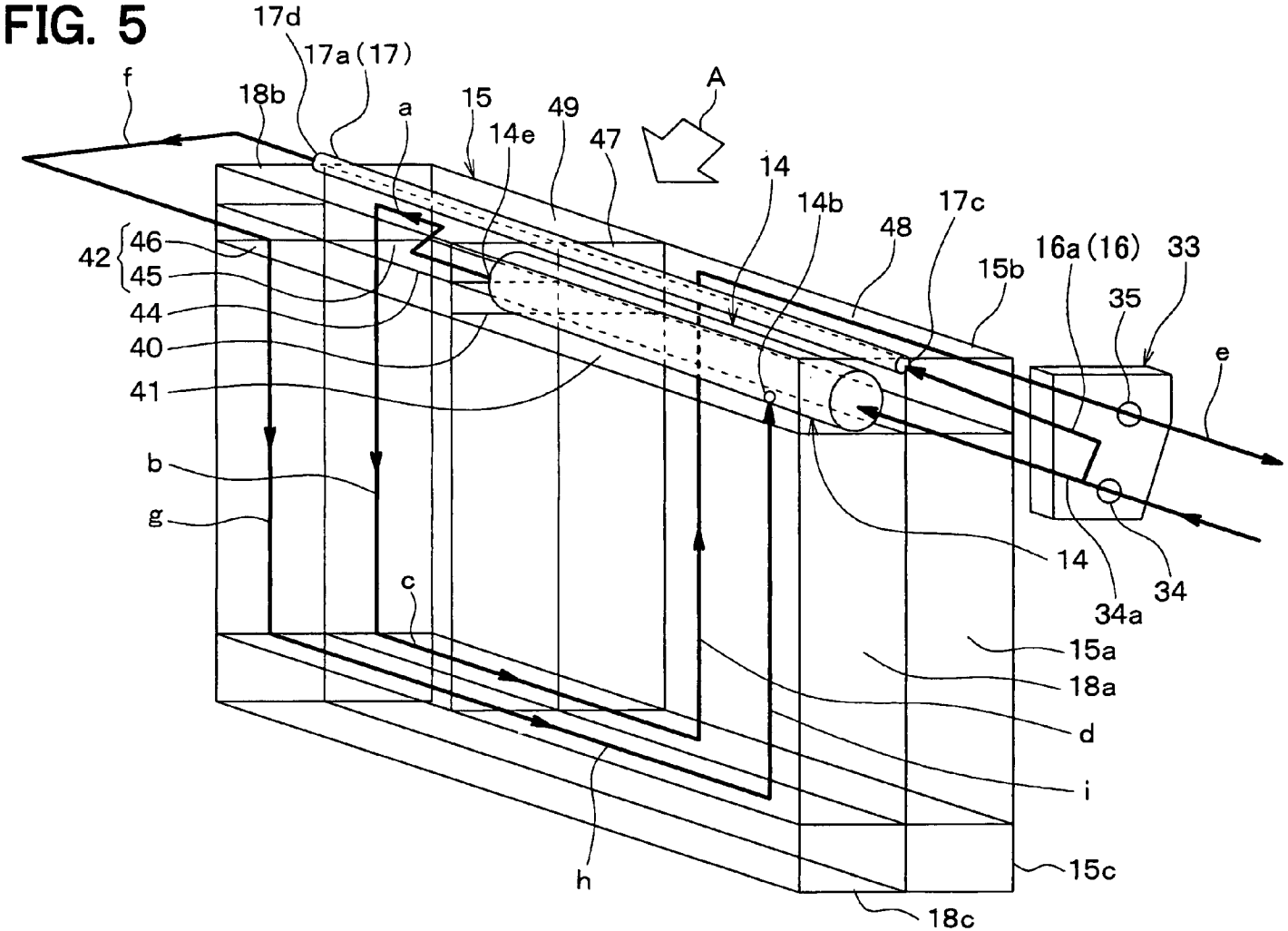
FIG. 5 is a schematic perspective view showing a refrigerant passage structure of the evaporator unit according to the first embodiment.

As shown in FIG. 5, the refrigerant inlet 34 is branched in the joint portion 33 into a main passage 34*a* extending to the nozzle portion 14*a* of the ejector 14, and a branch passage 16*a* corresponding to the refrigerant branch passage 16 of FIG. 1. Thus, the branch portion Z of FIG. 1 is configured within the joint portion 33. In contrast, the refrigerant outlet 35 is a simple passage penetrating through the joint portion 33, as shown in FIG. 5.

The joint portion 33 is brazed and fixed to the side surface portion of the upper tanks 15*b*, 18*b*. An outlet side opening portion of the branch passage 16*a* of the joint portion 33 is air-tightly connected to an upstream end portion 17*c* of the capillary tube 17*a* by brazing.

The joint portion 33 is brazed to the side surface portion of the upper tanks 15*b*, 18*b*, such that the refrigerant outlet 35 communicates with the upper tank 15*b*, the main passage 34*a* communicates with the upper tank 18*b*, and the branch passage 16*a* communicates with the upstream end portion 17*c* of the capillary tube 17*a*.

In the example of FIG. 3, the refrigerant inlet 34 and the refrigerant outlet 35 of the joint portion 33 open toward upwardly. The thermal expansion valve 13 is fixed to the joint portion 33 around the refrigerant inlet 34 and the refrigerant outlet 35 by screwing. After the ejector 14 is inserted into the upper tank 18*b* via the ejector-insertion hole portion (not shown), the ejector-insertion hole portion is closed by a cover member 36.

An ejector fixing plate 40 is provided in the upper tank 18*b*, to fix the diffuser 14*d* of the ejector 14 and to partition an inner space of the upper tank 18*b* into a first space 41 and a second space 42. The first space 41 of the upper tank 18*b* is used as a collection tank space in which the refrigerant having passed through the plural tubes 21 of the second evaporator 18 is collected.

The ejector fixing plate 40 is located approximately at a center portion in the longitudinal direction of the upper tank 18*b*, and is fixed to the inner wall surface of the upper tank 18*b* by brazing. A cylindrical portion 40*a* protruding from the ejector fixing plate 40 in the longitudinal direction of the upper tank 18*b* is formed from an aluminum material. The cylindrical portion 40*a* penetrates through a through hole of the elector fixing plate 40. The diffuser 14*d* is inserted into the cylindrical portion 40*a* of the ejector fixing plate 40 to be fixed into the cylindrical portion 40*a*.

As shown in FIGS. 3 and 4B, the downstream end portion of the capillary tube 17*a* is air-tightly joined to a connection joint 43 by brazing. The connection joint 43 is fixed to the end portion of the tank header 31 on a side adjacent to the cap 32. The connection joint 43 has therein a communication passage (not shown) through which the downstream end portion of the capillary tube 17*a* and the second space 42 of the upper tank 18*b* communicate with each other.

As shown in FIG. 4A, an opening portion 31*d* is provided at the end portion of the tank header 31 on the side adjacent to the cap 32, so that the communication passage of the connection joint 43 communicates with the second space 42 of the upper tank 18*b* through the opening portion 31*d*. Thus, the downstream end portion 17*d* of the capillary tube 17*a* communicates with the second space 42 of the upper tank 18*b* on a side adjacent to the cap 32, via the communication passage of the connection joint 43 and the opening portion 31*d* of the tank header 31.

An up-down partition plate 44 is located in the second space 42 of the upper tank 18*b* approximately at a center portion in an up-down direction of the second space 42, so as to partition the second space 42 of the upper tank 18*b* into an upper side space 45 and a lower side space 46 within the second space 42, as shown in FIGS. 3 and 5. The lower space 46 of the second space 42 is used as a distribution tank space from which the refrigerant is distributed into the plural tubes 21 of the second evaporator 18.

The up-down partition plate 44 is formed from an aluminum material, and is fixed to an inner wall surface of the upper tank 18*b* by brazing. The up-down partition plate 44 is formed into a plate shape extending in the longitudinal direction of the upper tank 18*b*.

The up-down partition plate 44 is not provided in a space part adjacent to the cap 32 within the second space 42 to form a non-partition space part at the side adjacent to the cap 32, so that refrigerant flows in the second space 42 upwardly through the non-partition space part. Thus, the lower space 46 of the second space 42 communicates with the communication passage of the connection joint 43 through the non-partition space part of the second space 42.

The ejector 14 can be formed from a metal material such as copper or aluminum. Alternatively, the ejector 14 may be formed from a non-metal material such as a resin material. In the present embodiment, after the first and second evaporators 15, 18 and other components are integrally brazed, the ejector 14 is inserted into an inner portion Of the upper tank 18*b* after penetrating through the ejector-insertion hole portion of the joint portion 33. The ejector-insertion hole portion is closed by the cover member 36 after the ejector 14 is inserted into the inner portion of the upper tank 18*b*.

The tip end portion (i.e., right end portion of FIG. 3) of the longitudinal direction of the ejector 14 corresponds to an outlet portion 14*e* of the ejector 14 of FIG. 1. The tip end portion of the ejector 14 is inserted into the cylindrical portion 40*a* of the ejector fixing plate 40, and is open at the upper space 45 of the second space 42 within the upper tank 18*b*, as shown in FIG. 5. The refrigerant suction port 14*b* of the ejector 14 is located to communicate with the first space 41 of the upper tank 18*b* of the second evaporator 18, as shown in FIG. 5.

As shown in FIG. 3, a left-right partition plate 47 is located approximately at a center portion of the inner space of the upper tank 15*b* of the first evaporator 15 in the tank longitudinal direction. Therefore, the inner space of the upper tank 15*b* can be partitioned into a first space 48 and a second space 49 in the tank longitudinal direction by the left-right partition plate 47.

The first space 48 is used as a collection tank space in which the refrigerant after passing through the plural tubes 21 of the first evaporator 15 is joined and collected, and the second space 49 is used as a distribution tank space from which the refrigerant is distributed into the plural tubes 21 of the first evaporator 15.

The upper space 45 of the upper tank 18*b* of the second evaporator 18 communicates with the second space 49 in the upper tank 15*b* of the first evaporator 15 via plural communication holes (not shown) between the upper space 45 of the upper tank 18*b* and the second space 49 of the upper tank 15*b*.

The ejector 14 is fixed to the upper tanks 15*b*, 18*b* of the first and second evaporators 15, 18 in the longitudinal direction of the ejector 14, as follows. First, the ejector 14 is inserted into the upper tank 18*b* from the ejector-insertion hole portion (not shown) of the joint portion 33, and then the ejector-insertion hole portion is closed by the cover member 36 so that the ejector 14 is fixed to the upper tank 18*b* by the cover member 36.

In the present embodiment, the inner space of the upper tank 18*b* of the second evaporator 18 is partitioned into the first and second spaces 41, 42 by the ejector fixing plate 40. The first space 41 is used as a collection tank space in which the refrigerant after passing through the plural tubes 21 is collected, and the second space 42 is used as a distribution tank space from which the refrigerant is distributed into the plural tubes 21.

The ejector 14 has a thin elongated shape extending in the axial direction of the nozzle portion 14*a*. The longitudinal direction of the ejector 14 is made to correspond to the longitudinal direction of the upper tank 18*b*, such that the longitudinal direction of the ejector 14 is generally parallel with the longitudinal direction of the upper tank 18*b*.

Thus, the ejector 14 and the evaporator 18 can be arranged in compact, thereby reducing the size of the evaporator unit 20. Furthermore, the ejector 14 is located in the upper tank 18*b* such that the refrigerant suction port 14*b* is directly opened into the first space 41 that is used as the collection tank space.

Thus, it is possible to reduce the number of the refrigerant piping in the evaporator unit 20. Because the refrigerant suction port 14*b* is directly opened into the first space 41, the refrigerant collection from the tubes 21 and the refrigerant suction into the ejector 14 can be performed by using a single tank space.

In the present embodiment, the first evaporator 15 and the second evaporator 18 are arranged adjacent to each other, and the downstream end portion of the ejector 14 is located adjacent to the second space 49 of the upper tank 15*b* of the first evaporator 15. Thus, even when the ejector 14 is incorporated into the second evaporator 18, the refrigerant passage structure from the outlet of the ejector 14 to the first evaporator 15 can be made simple and short.

The refrigerant flow in the entire evaporator unit 20 will be described with reference to FIGS. 2, 3 and 5.

The refrigerant inlet 34 of the joint portion 33 is branched into the main passage 34*a* and the refrigerant branch passage 16 (16*a*). The branched refrigerant flowing into the main passage 34*a* from the refrigerant inlet 34 flows into the nozzle portion 14*a* of the ejector 14 to be decompressed by the nozzle portion 14*a*. The refrigerant flowing into the nozzle portion 14*a* of the ejector 14 is jetted from the jet port of the nozzle portion 14*a* to pass through the mixing portion 14*c* and the diffuser 14d. The refrigerant flowing out of the outlet 14*e* of the diffuser 14*d* of the ejector 14 flows into the second space 49 of the upper tank 15*b* of the first evaporator 15 as in the arrow "a" in FIG. 5 via the upper space 45 of the second space 42 of the upper tank 18*b* and the plural communication holes (not shown) between the upper tanks 15*b* and 18*b*.

The refrigerant flowing from the diffuser 14*d* of the ejector 14 into the second space 49 of the upper tank 15*b* of the first evaporator 15 is distributed into the plural tubes 21 on the left side portion of the heat exchange core 15*a*, and flows downwardly in the tubes 21 as in the arrow "b" to be collected into the lower tank 15*c* of the first evaporator 15, as shown in FIG. 5. Because no partition plate is provided in the lower tank 15*c*, the refrigerant flows in the lower tank 15*c* as in the arrow "c" from the left side to the right side in FIG. 5 when being viewed from a direction opposite to the air flow direction "A" in FIG. 5.

The refrigerant at the right side of the lower tank 15*c* passes through the plural tubes 21 on the right side of the heat exchange core 15*a* upwardly as shown by the arrow "d", and flows into the first space 48 of the upper tank 15*b*. Then, as shown by the arrow "e" of FIG. 5, the refrigerant flows out of the refrigerant outlet 35 of the joint portion 33.

The refrigerant flowing into the refrigerant branch passage 16 (16*a*) of the joint portion 33 passes through the capillary tube 17*a*, and is decompressed by the capillary tube 17*a* to have a low pressure. The vapor-liquid two-phase refrigerant decompressed by the capillary tube 17*a* flows into the lower space 46 of the second space 42 of the upper tank 18*b* of the second evaporator 18, as shown by the allow "f" of FIG. 5.

The refrigerant flowing into the lower space 46 of the second space 42 of the upper tank 18*b* flows downwardly in the plural tubes 21 on the left side of the heat exchanger core 18*a* as in the arrow "g" in FIG. 5, and flows into the left portion of the lower tank 18*c*. Because no partition plate is provided in the lower tank 18*c*, the refrigerant flows in the lower tank 18*c* as in the arrow "h" from the left side to the right side in FIG. 5 when being viewed from the direction opposite to the air flow direction "A" in FIG. 5.

The refrigerant at the right side of the lower tank 18*c* passes through the plural tubes 21 on the right side of the heat exchange core 18*a* upwardly as shown by the arrow "d", and flows into the first space 41 of the upper tank 18*b*. Because the refrigerant suction port 14*b* of the ejector 14 is made to directly communicate with the first space 41 of the upper tank 18*b*, the refrigerant in the first space 41 is drawn into the ejector 14 from the refrigerant suction port 14*b*.

Because the evaporator unit 20 has therein the above refrigerant passage structure, the single refrigerant inlet 34 is provided in the joint portion 33 to be used for the refrigerant passage structure of the evaporator unit 20, and the single refrigerant outlet 35 is provided in the evaporator unit 20 to be used for the refrigerant passage structure of the evaporator unit 20.

Now, an operation of the refrigerant cycle device having the evaporator unit 20 according to the first embodiment will be described. When the compressor 11 is driven by a vehicle engine, the high-temperature and high-pressure refrigerant compressed by and discharged from the compressor 11 flows into the radiator 12 where the high-temperature refrigerant is cooled and condensed by the outside air. The high-pressure refrigerant flowing out of the radiator 12 flows into the liquid receiver 12*a* within which the refrigerant is separated into liquid and vapor phases. The liquid refrigerant is derived from the liquid receiver 12*a* and passes through the expansion valve 13.

The expansion valve 13 adjusts the degree of opening of the valve to adjust a refrigerant flow amount, such that the superheat degree of the refrigerant on the refrigerant outlet side of the first evaporator 15 becomes a predetermined value, while the high-pressure refrigerant is decompressed. Here, the refrigerant on the refrigerant outlet side of the first evaporator 15 corresponds to the refrigerant to be drawn to the compressor 11. The refrigerant having passed through the expansion valve 13 flows into the refrigerant inlet 34 provided in the joint portion 34 of the evaporator unit 20. The refrigerant after passing through the expansion valve 13 has a middle pressure.

The refrigerant flowing into the evaporator unit 20 from the refrigerant inlet 34 is branched at the branch portion Z to be divided into the refrigerant stream (first stream) directed to the nozzle portion 14*a* of the ejector 14 through the main passage 34*a* of the joint portion 33, and the refrigerant stream (second stream) directed to the capillary throttle 17*a* (17) through the branch passage 16*a* (16) of the joint portion 33.

The refrigerant flowing into the ejector 14 is decompressed and expanded by the nozzle portion 14*a*. Thus, the pressure energy of the refrigerant is converted into the speed energy at the nozzle portion 14*a*, and the refrigerant is ejected from the jet port of the nozzle portion 14*a* at high speed. At this time, the pressure drop of the refrigerant around the jet port of the nozzle portion 14*a* causes to draw from the refrigerant suction port 14*b*, the refrigerant (vapor-phase refrigerant) having passed through the heat exchange core 18*a* of the second evaporator 18.

The refrigerant ejected from the nozzle portion 14*a* and the refrigerant drawn from the refrigerant suction port 14*b* are combined in the mixing portion 14*c* on the downstream side of the nozzle portion 14*a* to flow into the diffuser 14*d*. In the diffuser 14*d*, the speed (expansion) energy of the refrigerant is converted into the pressure energy by enlarging the passage sectional area, resulting in increased pressure of the refrigerant.

The refrigerant flowing out of the diffuser 14*d* of the ejector 14 flows through the refrigerant flow paths indicated by the arrows "a" to "e" in FIG. 5. During this time, in the heat exchange core 15*a* of the first evaporator 15, the low-temperature and low-pressure refrigerant absorbs heat from the blown air in the direction of the arrow "A" so as to be evaporated. The vapor-phase refrigerant evaporated is drawn from the single refrigerant outlet 35 into the compressor 11, and is compressed again in the compressor 11.

The refrigerant flowing into the capillary tube 17*a* (i.e., throttle 17) is decompressed to become a low-pressure refrigerant (liquid-vapor two-phase refrigerant). The low-pressure refrigerant flows through the refrigerant flow paths in the second evaporator 18 as indicated by the arrows "f" to "i" of FIG. 5. During this time, in the heat exchange core 18*a* of the second evaporator 18, the low-temperature and low-pressure refrigerant absorbs heat from the blown air having passed through the first evaporator 15 to be evaporated. The vapor-phase refrigerant evaporated in the heat exchange core 18*a* of the second evaporator 18 is drawn from the refrigerant suction port 14*b* into the ejector 14.

According to the first embodiment, because the refrigerant downstream of the diffuser 14*d* of the ejector 14 is supplied to the first evaporator 15 while the refrigerant branched at the branch portion Z is supplied to the second evaporator 18 via the capillary tube 17*a* (i.e., throttle 17), cooling capacity can be obtained in both the first and second evaporators 15 and 18 at the same time. Therefore, the air cooled by both the first and second evaporators 15, 18 can be blown into a space to be cooled, thereby sufficiently cooling the space to be cooled.

The refrigerant evaporation pressure of the first evaporator 15 corresponds to the refrigerant pressure pressurized in the diffuser 14*d*. On the other hand, because the refrigerant outlet side of the second evaporator 18 is connected to the refrigerant suction port 14*b* of the ejector 14, the lowest pressure immediately after the decompression of the nozzle portion 14*a* can be applied to the second evaporator 18.

Accordingly, the refrigerant evaporation pressure (refrigerant evaporation temperature) of the second evaporator 18 can be made lower than the refrigerant evaporation pressure (refrigerant evaporation temperature) of the first evaporator 15. Furthermore, the first evaporator 15 having a relatively high refrigerant evaporation temperature is arranged upstream of the second evaporator 18 having a relatively low refrigerant evaporation temperature, in the flow direction A of air. Therefore, both a temperature difference between the refrigerant evaporation temperature and the temperature of the blown air in the first evaporator 15, and a temperature difference between the refrigerant evaporation temperature and the temperature of the blown air in the second evaporator 18 can be sufficiently obtained.

Therefore, cooling performance can be improved in both of the first evaporator 15 and the second evaporator 18, thereby improving cooling performance by using the combination of both the first and second evaporators 15, 18. Furthermore, because the refrigerant pressure is increased in the diffuser 14*d* of the ejector 14, the refrigerant suction pressure of the compressor 11 can be increased, thereby reducing the drive power of the compressor 11.

The refrigerant flow amount on the second evaporator 18 side can be adjusted independently by the capillary tube 17*a* (i.e., throttle 17) without directly depending on the function of the ejector 14, and the refrigerant flow amount flowing into the first evaporator 15 can be adjusted by a throttle characteristic of the nozzle portion 14*a* of the ejector 14. Thus, the refrigerant flow amounts flowing into the first and second evaporators 15 and 18 can be adjusted readily, to correspond to the respective heat loads of the first and second evaporators 15 and 18.

For a small cycle heat load, the difference between high and low pressures in the refrigerant cycle becomes small, and the input of the ejector 14 also becomes small. If the refrigerant flow amount passing through the second evaporator 18 depends on only the refrigerant suction ability of the ejector 14 at the small cycle heat load, it results in decreased input of the ejector 14, deterioration in the refrigerant suction ability of the ejector 14, and decrease in the refrigerant flow amount of the second evaporator 18 in order, making it difficult to secure the cooling performance of the second evaporator 18.

In contrast, in the embodiment, the refrigerant having passed through the expansion valve 13 is branched at the upstream part of the nozzle portion 14*a* of the ejector 14, and the branched refrigerant is drawn into the refrigerant suction port 14*b* through the branch passage 16, so that the refrigerant branch passage 16 is in a parallel connection relation to the ejector 14.

Thus, the refrigerant can be supplied to the branch passage 16, using not only the refrigerant suction ability of the ejector 14, but also the refrigerant suction and discharge abilities of the compressor 11. This can reduce the degree of decrease in the refrigerant flow amount on the second evaporator side 18 as compared with in the comparative cycle, even in the occurrence of phenomena, including decrease in input of the ejector 14, and deterioration in the refrigerant suction ability of the ejector 14. Accordingly, even under the condition of the low heat load, the cooling performance of the second evaporator 18 can be secured readily.

According to the first embodiment, the ejector 14, the first and second evaporators 15, 18 and the capillary tube 17*a* are assembled as a single unit structure, that is, as the evaporator unit 20, and the evaporator unit 20 is provided with the single refrigerant inlet 34 and the refrigerant outlet 35.

As a result, when the refrigerant cycle device 10 is mounted to the vehicle, the evaporator unit 20 provided with the various components (14, 15, 18, 17*a*) is connected as the whole such that the single refrigerant inlet 34 is connected to the refrigerant outlet side of the expansion valve 13 and the single refrigerant outlet 35 is connected to the refrigerant suction side of the compressor 11.

Furthermore, the ejector 14 is located within the tank portion (evaporator tank portion) of the first and second evaporators 15, 18, and the capillary tube 17*a* is integrated to the evaporator tank portion as shown in FIG. 3. Therefore, the size of the evaporator unit 20 can be made smaller and more simple, thereby improving the mounting space of the evaporator unit 20. As a result, in the first embodiment, the mounting performance of the refrigerant cycle device 10 in the vehicle can be improved, and the connection passage length for connecting the ejector 14, the capillary tube 17*a* and the first and second evaporators 15, 18 can be effectively reduced. Because the connection passage length for connecting the ejector 14, the capillary tube 17*a* and the first and second evaporators 15, 18 is made minimum in the evaporator unit 20, pressure loss in the refrigerant passage of the evaporator 20 can be reduced, and heat exchanging amount of the low-pressure refrigerant in the evaporator unit 20 with its atmosphere can be reduced. Accordingly, the cooling performance of the first and second evaporators 15, 18 can be effectively improved.

Because the refrigerant outlet side of the second evaporator 18 is connected to the refrigerant suction port 14*b* of the ejector 14 without using a pipe, the evaporation pressure of the second evaporator 18 can be made lower by a pressure due to the pipe-caused pressure loss, thereby the cooling performance of the second evaporator 18 can be improved without increasing the compressor-consumed power.

Furthermore, because the ejector 14 is located in the evaporator tank part having a low-temperature condition, it is unnecessary to attach a heat insulating member to the ejector 14.

According to the fixing structure of the capillary tube 17*a* of the first embodiment, the following effects and advantages can be obtained.

(1) The two longitudinal end portions (i.e., inlet portion and outlet portion) of the capillary tube 17*a* are air-tightly bonded to respective connection portions. In addition, because at least one portion of the capillary tube 17*a* between the two longitudinal ends of the capillary tube 17*a* is fixed to the tank header 31, a vibration (vibration amplitude) of the capillary tube 17*a* due to the refrigerant flow can be reduced. Therefore, the vibration at the two longitudinal ends of the capillary tube 17*a* can be reduced, thereby preventing a crack from being generated at the connection portions of the two longitudinal ends of the capillary tube 17*a*.

(2) Because at least one portion of the capillary tube 17*a* between the two longitudinal ends of the capillary tube 17*a* is fixed to the tank header 31, a distance between adjacent support portions of the capillary tube 17*a* can be made shorter in the longitudinal direction of the capillary tube 17*a*.

Thus, the natural frequency of the capillary tube 17*a* becomes larger and is greatly different from the vibration frequency due to the refrigerant flow. As a result, the vibration of the capillary tube 17*a* can be reduced, thereby reducing noise due to vibration of the capillary tube 17*a*.

In a general configuration of the evaporator unit 20, the vibration frequency of the capillary tube 17*a* caused due to the refrigerant flow is almost in an area of 2-5 kHz which is easily heard by human. Furthermore, the outer diameter of the capillary tube 17*a* is generally equal to or smaller than 6 mm.

In the present embodiment, because the capillary tube 17*a* is fixed to the tank header 31 at distances equal to or smaller than 75 mm, so that the primary natural frequency is set to be larger than 5 kHz. Thus, the natural frequency of the capillary tube 17*a* can be separated from the vibration frequency due to the refrigerant flow, thereby reducing the vibration of the capillary tube 17*a*.

(3) In the present embodiment, the protrusion portions 31*c* are formed in the tank header 31, and the middle portion of the capillary tube 17*a* between the longitudinal two ends of the capillary tube 17*a* is fixed to the protrusion portions 31*c* at plural positions. Therefore, contact and fixing area between the middle portion of the capillary tube 17*a* and the tank header 31 is determined by the protrusion portions 31*b* provided on the tank header 31.

Accordingly, by suitably setting the dimension, the shape and the arrangement or the like of the protrusion portion(s) 31*b*, the vibration of the capillary tube 17*a* can be effectively reduced.

(4) In the present embodiment, the space between the protrusion portions 31*c*, which are offset from each other in the longitudinal direction of the capillary tube 17*a*, can be made slightly smaller when being viewed from the direction parallel to the tank longitudinal direction, than the outer diameter of the capillary tube 17*a*. Therefore, the capillary tube 17*a* can be press-fitted into the valley portion 31*a* between the protrusion portions 31*c* at both sides of the valley portion 31*a*.

Therefore, the portion of the capillary tube 17*a* between the longitudinal ends of the capillary tube 17*a* can be accurately fixed to the tank header 31, thereby reducing the vibration of the capillary tube 17*a* due to the refrigerant flow.

If the whole capillary tube 17*a* is fixed to the tank header 31, the capillary tube 17*a* is difficult to be bent, and thereby the capillary tube 17*a* may be difficult to be accurately fixed to the tank header 31.

In the present embodiment, the protrusion portions 31*c* are arranged in the tank header 31 by a predetermined distance in the tank longitudinal direction. Thus, if the capillary tube 17*a* is assembled to the tank header 31, the protrusion portions 31*c* are pressed to the outer peripheral surface of the capillary tube 17*a*, and thereby the capillary tube 17*a* is easily bent.

Thus, a spring back force (bending return force) is caused in the capillary tube 17*a*, and a friction force is caused between the capillary tube 17*a* and the protrusion portion 31*c*. Therefore, the capillary tube 17*a* can be accurately fixed to the tank header 31.

The dimension of the protrusion portion 31*c* in the tank longitudinal direction is set equal to or smaller than 30 mm, for example. In this case, the advantage of the protrusion portions 31*c* can be improved.

(5) In the present embodiment, the protrusion portions 31*c* are arranged in zigzag in the longitudinal direction so that the protrusion portions 31*c* at the two sides of the valley portion 31*a* are offset from each other in the tank longitudinal direction. Plural pairs of protrusion portions 31*c* opposite to each other in a tank minor direction perpendicular to the tank longitudinal direction may be provided in the tank header 31 in the tank longitudinal direction. However, in this case, when the capillary tube 17*a* is press-fitted to the tank header 31 between the protrusion portions 31*c*, the tank header 31 is easily deformed in the tank minor direction, and thereby it is difficult to accurately assemble the tank header 31 to a tank component such as the plate header 30. The strength of the tank header 31 may be increased in order to reduce its deformation. However, in this case, pressing force of the capillary tube 17*a* needs to be increased.

In contrast, in the present embodiment, because the protrusion portions 31*c* are arranged in zigzag in the longitudinal direction so that the protrusion portions 31*c* are offset from each other in the tank longitudinal direction. Thus, it can restrict the tank header 31 from being deformed in the tank minor direction when the capillary tube 17*a* is press-fitted to the tank header 31. Furthermore, the capillary tube 17*a* can be press-fitted between the protrusion portions 31*c*. Generally, the protrusion portions 31*c* are separated from each other in the tank longitudinal direction by a dimension equal to or larger than the outer diameter of the capillary tube 17*a*.

(6) In the present embodiment, because capillary tube 17*a* is fixed to the protrusion portions 31*c* of the tank header 31, the strength of the capillary tube 17*a* can be increased, and the vibration of the capillary tube 17*a* can be effectively reduced. When the brazing distance of the capillary tube 17*a* is equal to or smaller than 75 mm, the vibration reducing effect can be more improved.

(7) Because the protrusion portions 31*c* are formed by pressing out a part of the wall portion of the tank header 31 defining the tank space, the using material of the tank header 31 can be made smaller.

(8) In the present embodiment, the corner portion of the protrusion portion 31*c* is made to be a round shape. Therefore, the capillary tube 17*a* can be smoothly assembled to the tank header 31, and it can prevent the capillary tube 17*a* from being damaged while the capillary tube 17*a* is assembled to the tank header 31.

Second Embodiment

Figure 6A:
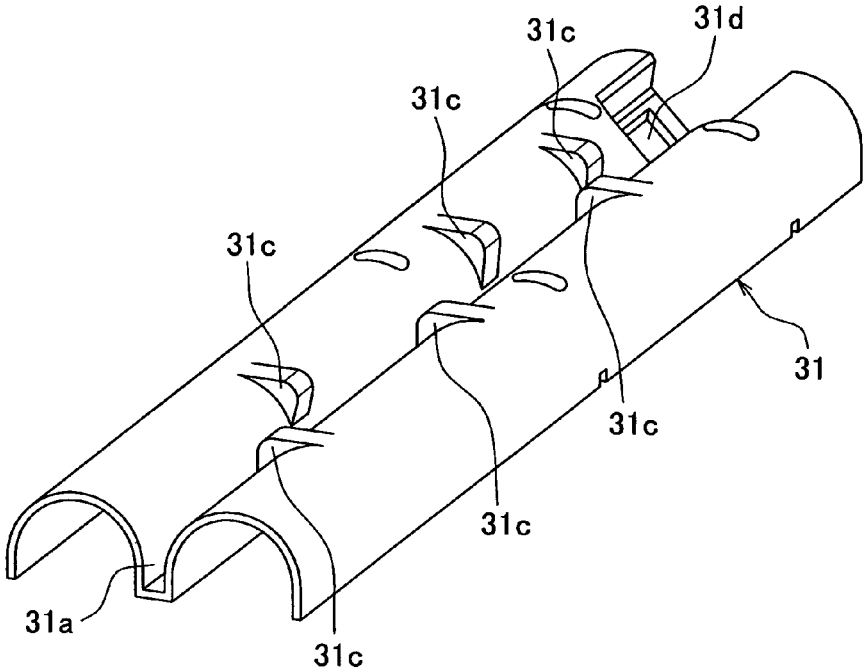
FIG. 6A is a perspective view showing a tank header for an evaporator unit before a capillary tube is attached.
Figure 6B:
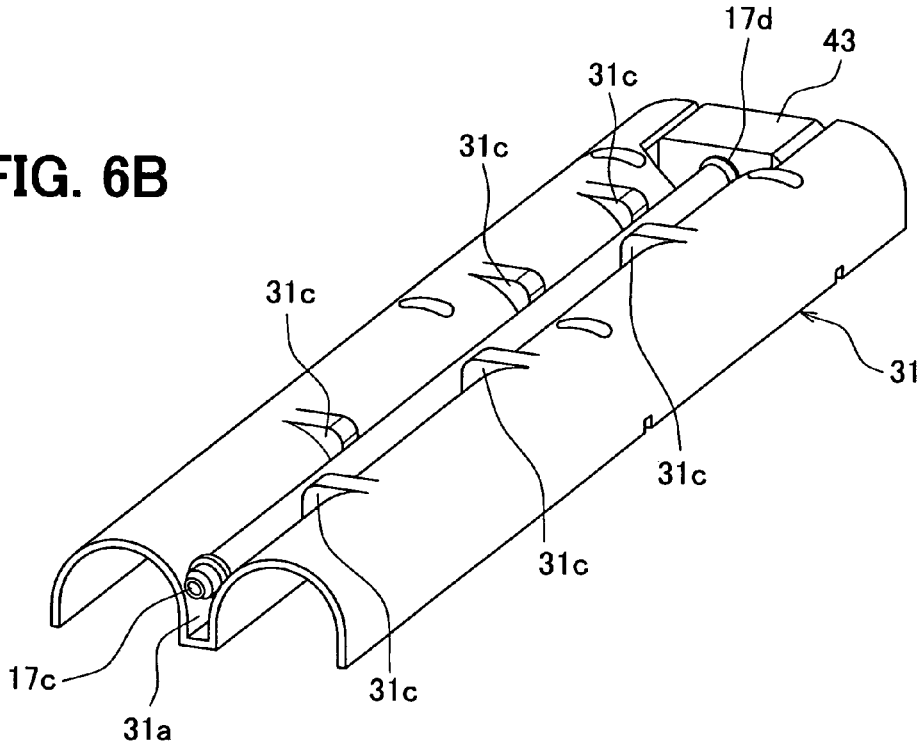
FIG. 6B is a perspective view showing the tank header for the evaporator unit after the capillary tube is attached, according to a second embodiment of the present invention.

In the above-described first embodiment, the plural ribs 31*b* are provided in the tank header 31 as shown in FIGS. 4A and 4B. However, in the second embodiment, as shown in FIGS. 6A and 6B, the ribs are not provided in the tank header 31. In the second embodiment, the other parts of the evaporator unit 20 and the refrigerant cycle device using the evaporator unit 20 are similar to those of the above described first embodiment.

Other Embodiments

It should be understood that the present invention is not limited to the above-mentioned embodiments, and various modifications can be made to the present embodiments as follows.

(1) In the above-described embodiments, the plural protrusion portions 31*c* are provided in the tank header 31 between the two longitudinal ends of the tank header 31. However, at least one of the protrusion portions 31*c* can be provided in the tank header 31 between the two longitudinal ends of the tank header 31. As one example, one of the protrusion portions 31*c* can be provided in the tank header 31 between the two longitudinal ends of the tank header 31.

Furthermore, the portion of the capillary tube 17*a* is not necessary to be fixed to all the protrusion portions 31*c*, and can be fixed to at least one of the protrusion portions 31*c* between the two longitudinal ends of the capillary tube 17*a*.

(2) In the above-described embodiments, the capillary tube 17*a* is arranged on an outer wall side of the tank header 31. However, the capillary tube 17*a* may be arranged on an inner wall side of the tank header 31.

The capillary tube 17*a* is not necessary to be fixed to the tank header 31. The capillary tube 17*a* may be fixed to a portion of the evaporators 15, 18 other than the tank header 31. For example, the capillary tube 17*a* may be fixed to a side surface of the heat exchange cores 15*a*, 18*a*, such that a portion of the capillary tube 17*a* between the two longitudinal ends of the capillary tube 17*a* contacts the side surface of the heat exchange cores 15*a*, 18*a* to be fixed to the side surface thereof.

(3) In the above-described embodiments, in integrally assembling respective components of the integrated unit 20, the components other than the ejector 14, that is, the first evaporator 15, the second evaporator 18, the joint portion 33, the capillary tube 17*a*, and the like are brazed integrally with each other. The integral assembly of these components can also be performed by various fixing means other than brazing, including screwing, caulking, welding, adhesion, and the like.

(4) Although in the above-described embodiments, the vapor-compression subcritical refrigerant cycle has been described in which the refrigerant is a flon-based one, an HC-based one, or the like, whose high pressure does not exceed the critical pressure, the invention may be applied to a vapor-compression supercritical refrigerant cycle which employs the refrigerant, such as carbon dioxide ($CO_2$), whose high pressure exceeds the critical pressure.

In the supercritical cycle, only the refrigerant discharged by the compressor dissipates heat in the supercritical state at the radiator 12, and hence is not condensed. Thus, the liquid receiver 12*a* disposed on the high-pressure side cannot exhibit a liquid-vapor separation effect of the refrigerant, and a retention effect of the excessive liquid refrigerant. In this case, the supercritical cycle may have the structure including an accumulator at the outlet of the first evaporator 15 for serving as the low-pressure liquid-vapor separator.

(5) Although in the above-described embodiments, the throttle 17 is constructed by a fixed throttle hole such as the capillary tube 17*a*, the throttle 17 may be constructed by an electric control valve whose valve opening (i.e., an opening degree of a passage restriction) is adjustable by the electric actuator.

Although in the above-mentioned respective embodiments, the exemplary ejector 14 is a fixed ejector having the nozzle part 14*a* with the certain path area, the ejector 14 may be a variable ejector having a variable nozzle part whose path area is adjustable.

For example, the variable nozzle part may be a mechanism which is designed to adjust the path area by controlling the position of a needle inserted into a passage of the variable nozzle part using the electric actuator.

(6) Although in the above-described embodiments, the invention is applied to the refrigerant cycle device adapted for cooling the interior of the vehicle and for the freezer and refrigerator, both the first evaporator 15 whose refrigeration evaporation temperature is high and the second evaporator 18 whose refrigeration evaporation temperature is low may be used for cooling different areas inside the compartment of the vehicle (for example, an area on a front seat side inside the compartment of the vehicle, and an area on a back seat side therein).

Alternatively or additionally, both the first evaporator 15 whose refrigeration evaporation temperature is high and the second evaporator 18 whose refrigeration evaporation temperature is low may be used for cooling the freezer and refrigerator. That is, a refrigeration chamber of the freezer and refrigerator may be cooled by the first evaporator 15 whose refrigeration evaporation temperature is high, while a freezing chamber of the freezer and refrigerator may be cooled by the second evaporator 18 whose refrigeration evaporation temperature is low.

(7) The present invention can be applied to any type evaporator unit described in the related art and any type refrigerant cycle device without an ejector 14. That is, the present invention can be used for an evaporator unit without an ejector 14.

(8) It is apparent that although in the above-mentioned respective embodiments, the refrigerant cycle device for the vehicle has been described, the invention can be applied not only to the vehicle, but also to a fixed refrigeration cycle or the like in the same way.

(9) In the above-described embodiments, the ejector 14 is located in the upper tank 18*b* of the second evaporator 18, and the downstream side end 17*d* of the capillary tube 17*a* is located in the upper tank 18*b* of the second evaporator 18. However, the ejector 14 may be located in the upper tank 15*b* of the first evaporator 15, and the downstream side end 17*d* of the capillary tube 17*a* may be located in the upper tank 15*b* of the first evaporator 15.

(10) Although in the above embodiments, the thermal expansion valve 13 and the temperature sensing part 13*a* are separately provided from the evaporator unit for the refrigerant cycle device, the thermal expansion valve 13 and the temperature sensing part 13*a* may be integrally incorporated in the evaporator unit for the refrigerant cycle device. For example, a mechanism for accommodating the thermal expansion valve 13 and the temperature sensing part 13*a* in the joint portion 33 of the evaporator unit 20 can be employed. In this case, the refrigerant inlet 34 is positioned between the liquid receiver 12*a* and the thermal expansion valve 13, and the refrigerant outlet 26 is positioned between the compressor 11 and a passage part on which the temperature sensing part 13*a* is installed.

(11) Although in the above-described embodiments, the evaporator unit 20 is used as an interior heat exchanger, and the radiator 12 is used as the exterior heat exchanger. However, the evaporator unit 20 may be used as an exterior unit configured to absorb heat from outside air as a heat source, and the radiator 12 may be used as an interior heat exchanger for heating a fluid such as water or air, in a heat pump cycle.

Such changes and modifications are to be understood as being within the scope of the present invention as defined by the appended claims.

What is claimed is:

1. An evaporator unit comprising:

an evaporator configured to evaporate a refrigerant; and a capillary tube configured to decompress the refrigerant, wherein the capillary tube has two ends in a longitudinal direction of the capillary tube, and a middle portion between the two ends in the longitudinal direction, the two ends of the capillary tube are bonded to the evaporator, at least one position of the middle portion of the capillary tube in the longitudinal direction is fixed to the evaporator by contacting the evaporator;

the evaporator includes a plurality of heat exchange tubes in which the refrigerant flows, and a tank elongated in a tank longitudinal direction that is in parallel with an arrangement direction of the heat exchange tubes to distribute the refrigerant into the heat exchange tubes or to collect the refrigerant from the heat exchange tubes, the tank includes a tank header for defining a tank space, the middle portion of the capillary tube in the longitudinal direction contacts the tank header in the evaporator to be fixed to the tank header, the tank header has at least one protrusion portion protruding to a position of the middle portion of the capillary tube, the middle portion of the capillary tube contacts the protrusion portion of the tank header to be fixed to the tank header, and the protrusion portion is formed by a part of the tank header defining a fluid passage.

2. The evaporator unit according to claim 1, wherein the middle portion of the capillary tube is fixed to the tank header at least at two positions in a zigzag shape.

3. The evaporator unit according to claim 1, wherein the middle portion of the capillary tube is fixed to the header tank by brazing.

4. The evaporator unit according to claim 1, wherein the tank includes a plate header into which the heat exchange tubes are inserted, and the tank header is bonded to the plate header to form a tank space between the plate header and the tank header.

5. The evaporator unit according to claim 1, wherein the tank header has a valley portion extending along a longitudinal direction of the tank header and being recessed such that the capillary tube is inserted in the valley portion in a radial direction of the capillary tube, and the protrusion portion protrudes from the valley portion to the middle portion of the capillary tube.

6. The evaporator unit according to claim 1, wherein the protrusion portion protrudes from the tank header by a dimension, to press-contact an outer surface of the capillary tube, and to bend the capillary tube by the press-contact.

7. The evaporator unit according to claim 1, wherein a plurality of the protrusion portions are arranged by a predetermined distance in the longitudinal direction of the capillary tube.

8. The evaporator unit according to claim 7, wherein the predetermined distance is equal to or smaller than 75 mm.

9. The evaporator unit according to claim 1, wherein a plurality of the protrusion portions are arranged to pinch the capillary tube in a radial direction of the capillary tube.

10. The evaporator unit according to claim 9, wherein the protrusion portions are arranged in a zigzag shape in the longitudinal direction of the capillary tube.

11. The evaporator unit according to claim 9, wherein the protrusion portions are configured to have a clearance therebetween when being viewed from a direction parallel to the longitudinal direction of the capillary tube, and the clearance being smaller than an outer diameter of the capillary tube.

12. The evaporator unit according to claim 1, wherein capillary tube is fixed to the protrusion portion by brazing.

13. The evaporator unit according to claim 1, wherein the protrusion portion is configured to have a rounded corner when being viewed from a direction parallel to the longitudinal direction of the capillary tube.

* * * * *